United States Patent [19]

Murphy

[11] 4,453,142

[45] Jun. 5, 1984

[54] MICROSTRIP TO WAVEGUIDE TRANSITION

[75] Inventor: Earl R. Murphy, Scottsdale, Ariz.

[73] Assignee: Motorola Inc., Schaumburg, Ill.

[21] Appl. No.: 317,661

[22] Filed: Nov. 2, 1981

[51] Int. Cl.[3] ..... H01P 5/107

[52] U.S. Cl. ..... 333/26; 333/33

[58] Field of Search ..... 333/21 R, 26, 33

[56] References Cited

U.S. PATENT DOCUMENTS

| | | | |
|---|---|---|---|
| 2,825,876 | 3/1958 | Le Vine et al. . | |
| 2,829,348 | 4/1958 | Kostriza et al. | 333/26 |
| 3,579,149 | 5/1971 | Ramsey . | |
| 3,715,635 | 2/1973 | Michel et al. . | |
| 4,006,425 | 2/1977 | Chang et al. . | |

OTHER PUBLICATIONS

Karapetyan et al., *Waveguide–Microstrip Transition with Low Losses for the 3 Cm Range,* Instr. & Exper. Tech., vol. 19, No. 3, Pt. 2, May–Jun. '76, (USSR), 333–26.

*Primary Examiner*—Paul L. Gensler

*Attorney, Agent, or Firm*—Jonathan P. Meyer; Eugene A. Parsons

[57] ABSTRACT

A microstrip to waveguide transition is achieved by passing a portion of a microstrip circuit through an aperture in a transverse wall of a waveguide. The aperture is dimensioned and positioned so as not to significantly disturb propagation in the waveguide. A tab of the microstrip substrate extends through the aperture and into the waveguide, where a probe disposed on the tab couples to energy in the waveguide. The probe is connected to the microstrip circuit by means of a transition section on the tab within the aperture. The transition section is as narrow as possible to minimize capacitive coupling to the waveguide wall and is an integral multiple of one-half wavelength for a smooth impedance match from the probe to the microstrip.

8 Claims, 3 Drawing Figures

MICROSTRIP TO WAVEGUIDE TRANSITION

FIELD OF THE INVENTION

The present invention relates, in general, to an apparatus for coupling a waveguide to a microstrip circuit. More particularly, the invention relates to a compact, right angle microstrip to waveguide transition suitable for use in millimeter wave circuits.

BACKGROUND OF THE INVENTION

Two familiar transmission media for high frequency electromagnetic energy are wave guides and microstrip circuits. Waveguides are hollow conductive conduits generally having a circular or rectangular cross section and are appropriate where transmission of energy from point to point with very low loss is desired. Microstrip circuits consist of a ground plane and a signal carrying microstrip separated by a dielectric material. Microstrip circuits are more subject to radiation and other losses than are waveguides, but may be inexpensively constructed by familiar photo etching techniques. Furthermore, signal processing components and microstrip interconnections are easily integrated onto a single dielectric substrate requiring less space than an equivalent waveguide circuit. In some systems, such as radar systems, it is necessary to utilize both microstrip and waveguide transmission media in different portions of the system. This, of course, requires the use of microstrip to waveguide transition apparatus which efficiently couples energy propagating in the one medium to the other medium.

It has been standard practice in the art to achieve microstrip to waveguide transitions through end-launch techniques. Several examples of such techniques are discussed in U.S. Pat. No. 2,825,876 for Radio Frequency Transducers, issued Mar. 4, 1958 to D. J. Le Vine et al. The salient feature of end-launch transitions is that the direction of propagation in the waveguide is parallel to that in the microstrip. In a system requiring different directions of propagation some form of waveguide apparatus must be utilized to change that direction. Various waveguide components such as Tees or corners are well-known for accomplishing such a change of direction, but they require substantial space and are costly in comparison with microstrip circuits. The size and weight represented by a waveguide Tee or corner are vital factors if the system is to be a part of an airborne vehicle or other compact, lightweight device. For instance, a guidance radar for use in a small missile may have no extra space or payload margin for bulky waveguide components.

U.S. Pat. No. 3,579,149 for Waveguide To Stripline Transition Means, issued May 18, 1971 to Kurt G. Ramsey discloses a right angle transition involving a waveguide and a stripline circuit, which is somewhat similar to a microstrip circuit. This transition, however, utilizes a waveguide Tee to change the direction of propagation and the plane of the E-field prior to coupling to the stripline circuit, thus entailing almost the same bulk as an end-launch transition and a subsequent Tee or corner.

SUMMARY OF THE INVENTION

Accordingly, it is an object of the present invention to provide an improved microstrip to waveguide transition.

A further object of the invention is to provide an improved right angle microstrip to waveguide transition.

A particular embodiment of the present invention comprises a rectangular waveguide having a small aperture in the center of a broad wall of the waveguide and spaced a short distance from a shorted end of the waveguide. The aperture is sized and placed so as to perturb fields propagating in the waveguide as little as possible. A microstrip line disposed on a dielectric substrate is connected to a probe located inside the waveguide by means of a one-half wavelength transition section. The transition section is as narrow as is practical to manufacture and the length thereof is approximately equal to the thickness of the waveguide wall. This transition section minimizes capacitive coupling between the waveguide wall and the microstrip circuit and it is one-half wavelength long to provide a smooth impedance transition from the probe to the microstrip line. The microstrip circuit and probe may be on the side of the substrate facing away from the waveguide short, which will be referred to as a normal transition, or the probe and circuit may be on the side facing toward the short, referred to as a reverse transition. Thus, the present invention allows access to a microstrip circuit from either side without additional waveguide Tees or corners. The probe, the transition section and microstrip line may be manufactured by familiar photo etching techniques.

These and other objects and advantages of the present invention will be apparent to one skilled in the art from the detailed description below taken together with the drawings.

DETAILED DESCRIPTION OF THE DRAWINGS

Figure 1:
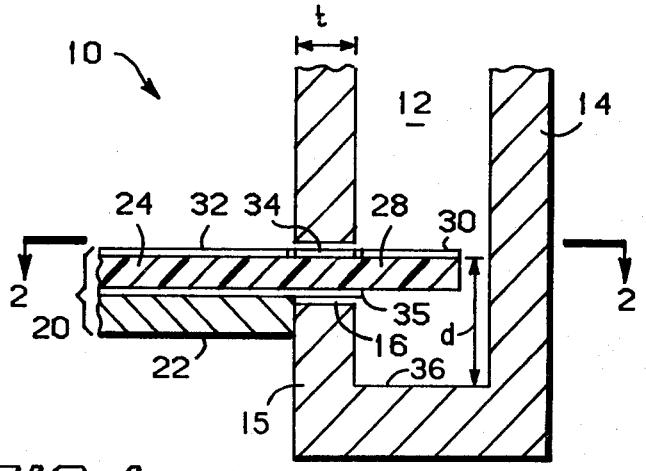
FIG. 1 is a cross-section of a normal microstrip to waveguide transition in accordance with the principles of the present invention.
Figure 2:
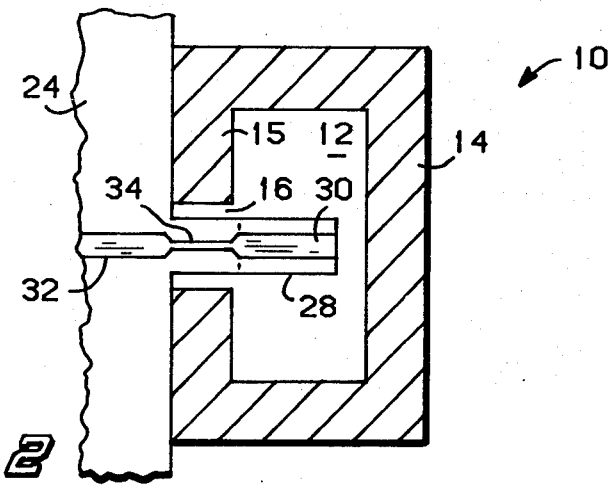
FIG. 2 is a top plan view of the apparatus of FIG. 1.

Referring to FIGS. 1 and 2, a normal microstrip to waveguide transition 10 in accordance with the principles of the present invention is shown in cross-section and top plan views, respectively. Waveguide 12 defined by metallic walls 14 of thickness t may be of any type familiar in the art. For example, a transition embodying the principles of the invention has been constructed using WR-10 rectangular waveguide having outside dimensions of 0.180×0.130 inches (0.457×0.330 cm) and a wall thickness t of 0.040 inches (0.102 cm). References to the test apparatus hereinbelow refer to a working transition using this waveguide. Waveguide 12 defines a first direction of propagation, which is the vertical direction in FIG. 1. Tranverse wall 15, in this case the broad wall, is pierced by aperture 16. The important feature of aperture 16 is that it must not be so large as to significantly disturb the propagation of energy in the waveguide. In the test apparatus referred to above, aperture 16 comprises a 0.030 (0.076 cm) inch hole drilled through the center of the broad wall of the WR-10 waveguide. The size and location of aperture 16 may be modified depending on the particular waveguide and propagation mode utilized, as will be apparent to one skilled in the art. A microstrip apparatus 20 is attached to waveguide 12 by means of metallic mounting base 22. Base 22 may be aluminum, for example, and is bolted or otherwise rigidly connected to waveguide 12. A dielectric substrate 24 is mounted on base 22. At lower frequencies, many familiar ceramic substrates are attractive for their well-known and constant electrical characteristics. The test apparatus is operable at a center frequency of 94 GHz. In this range ceramic substrates require more expensive metallizations such as gold and have a dielectric constant which requires very small line widths which are difficult to etch. For these reasons Teflon® substrates are attractive. By way of example, a Cuflon substrate, which is a product of the Polyflon Corporation of New Rochelle, N.Y., was used in the test apparatus and was found to have an effective dielectric constant of approximately 2.1. This particular board is 5 mils thick with a one-third mil copper sheet on both sides before etching. A tab 28 of dielectric substrate 24 extends through aperture 16 into the interior of waveguide 12. A ground plane 35 disposed on the side of substrate 24 which is attached to mounting base 22 extends into aperture 16. Ground plane 35 preferably extends a very short distance, such as 0.005 inches (0.013 cm), into the interior of waveguide 12. A probe 30 is disposed on a surface of tab 28 for coupling energy to and from waveguide 12. The design of probe 30 offers wide latitude for variation to optimize this coupling. In the case of the test apparatus, the patch of copper left on tab 28 to form probe 30 was repeatedly tested, hand trimmed and retested to obtain optimum dimensions. By way of example, one successful probe was approximatey 0.030 inches (0.076 cm) long and 0.016 (0.041 cm) wide. This width, as is familiar in the art, is related to the impedance of probe 30, which must be matched to the impedance of an external microstrip circuit 32 which has the same width as probe 30. The calculation of the impedance of a microstrip circuit is well-known in the art. The equations below are taken from "Microstrip Lines for Microwave Integrated Circuits", M. V. Schneider, Bell System Technical Journal, May–June 1969, pp. 1421–1444.

$$Z_{microstrip} = \frac{Z_{oAIR}}{\sqrt{\epsilon_{eff}}} \quad (1)$$

$$Z_{oAIR} = \frac{120\pi}{w/h + 2.42 - 0.44\,h/w + (1 - h/w)^6} \quad (2)$$

$$\epsilon_{eff} = \frac{\epsilon_r + 1}{2} + \frac{\epsilon_r - 1}{2}\left[1 + 10\left(\frac{h}{w}\right)\right]^{-\frac{1}{2}} \quad (3)$$

where w = microstrip width;

h = dielectric substrate thickness;

$\epsilon_r$ = effective dielectric constant of substrate;

$Z_{oAIR}$ = impedance for air dielectric microstrip line; and $w/h \geqq 1$.

It was found that a width of 0.016 inches (0.041 cm) on the substrate described above yields a 50 ohm impedance.

As is well-known in the art, efficient transmission of energy on a transmission line depends on a lack of impedance discontinuities along the line. Therefore, it is necessary to pass the signal from probe 30 through aperture 16 without significant perturbation. However, passage of a microstrip circuit through aperture 16 will result in a shunt capacitance between the circuit and waveguide wall 15 which will create an impedance discontinuity. For this reason, a microstrip transition section 34 connects microstrip circuit 32 and probe 30. Transition section 34 is disposed on that portion of tab 28 which lies within aperture 16. The length of section 34 is an integral multiple of one-half of a microstrip wavelength. In the test example, the microstrip wavelength is 0.092 inches (0.234 cm). So one-half wavelength is 0.046 inches (0.117 cm) which is just larger than the wall thickness of 0.040 inches (0.102 cm), so a one-half wavelength transition section is used. Larger multiples of one-half wavelength can be used if longer transitions are needed to extend through a thicker waveguide wall. A microstrip section of such length will transform the probe impedance to the microstrip line 32 without change, regardless of the impedance of transition section 34. This allows use of a very narrow transition section which minimizes shunt capacitance with waveguide wall 15. A width of 0.007 inches (0.018 cm), which corresponds to an impedance of approximately 80 ohms, has been used satisfactorily, although smaller widths are possible if they can be reliably etched. The transition from the larger width of circuit 32 and probe 30 to transition section 34 is preferably gradual. For example, a 0.010 inch (0.025 cm) long sloped section may be used to go from 0.016 inches (0.041 cm) wide to 0.007 inches (0.018 cm) wide. The exact dimensions used were optimized experimentally by several iterations of fabrication, testing, trimming and retesting.

Finally, short circuit means 36 provide a termination for waveguide 12. It has been found that the probe to short distance d is an important factor in the performance of this transition apparatus. A nominal distance of one-quarter of a waveguide wavelength is the starting point. For 94 GHz in a WR-10 waveguide, this distance is 0.0404 inches (0.103 cm). A sliding short is utilized to adjust the distance d while measuring the voltage standing wave ratio. In this manner, a distance d of 0.030 inches (0.076 cm) is found optimal for the test apparatus, providing a maximum VSWR of 1.40 at 90 GHz and a minimum of 1.16 at 98 GHz. The probe to short distance d may be substantially modified to provide optimum efficiency. It is anticipated that a fixed waveguide wall or the like will provide shorting means 36 in future models.

Transition 10 according to FIGS. 1 and 2 is a normal transition; that is, probe 30 faces away from short circuit means 36. This is appropriate where the source of the signal in waveguide 12, which may be from an antenna or the like, is located in the direction of the microstrip side of substrate 24 as opposed to the ground plane side. In some systems, it is necessary to have waveguide inputs to the microstrip circuit from both sides, which requires a reverse transition.

Figure 3:
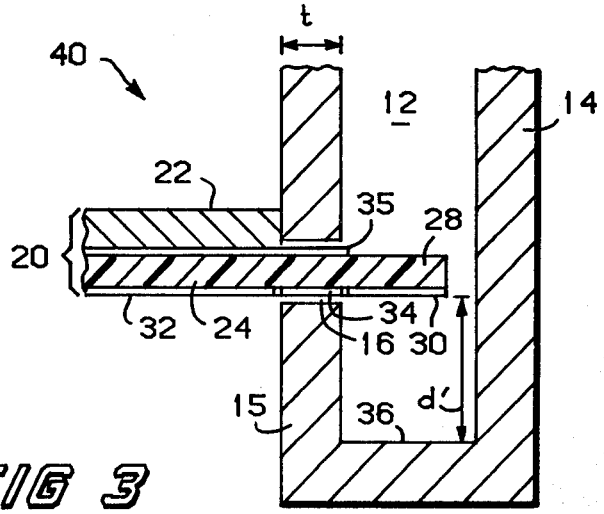
FIG. 3 is a cross-section of a reverse microstrip to waveguide transition in accordance with the principles of the present invention.

Referring now to FIG. 3, a reverse transition 40 in accordance with the principles of the present invention is shown in cross section. The description of this transition is identical to that of the normal transition 10 of FIGS. 1 and 2 except that microstrip apparatus 20 is reversed so that probe 30 faces toward short circuit means 36. It has been found that a reverse transition may be optimized at a different probe to short distance d'. Reverse transitions were achieved in the test apparatus by simply inserting apparatus 20 upside down into aperture 16. At a distance d' of 0.035 inches (0.089 cm) the transition VSWR varied between approximately 1.23 and 1.10 over the frequency range of 90 GHz to 98 GHz.

The present invention provides a right angle microstrip to waveguide transition which is operable at millimeter wave frequencies. The transition requires no waveguide Tees or other components and is realizable on inexpensive substrates. This transition is capable of performing in either a normal or a reverse manner, thus allowing access to a microstrip integrated circuit from both sides.

While the invention has been particularly shown and described with reference to a preferred embodiment thereof, it will be understood by those skilled in the art that various other modifications and changes may be made to the present invention from the principles of the invention described above without departing from the spirit and scope thereof.

I claim:

1. A right angle microstrip to waveguide transition, comprising:

a waveguide defining a first direction of propagation;

an aperture through a transverse wall of said waveguide;

probe means disposed inside said waveguide for coupling to energy propagating in said waveguide;

a circuit defining a second direction of propagation substantially perpendicular to said first direction of propagation; and a microstrip transition section disposed in said aperture connected at one end thereof to said probe means and at another end thereof to said circuit, said microstrip transition section having a length at least as great as a thickness of said waveguide wall and a predetermined width, said length being an integral multiple of one-half of a microstrip wavelength.

2. The transition according to claim 1 further comprising:

short circuit means for terminating said waveguide, said short circuit means being located a predetermined distance from said probe means.

3. The transition according to claim 2 wherein said waveguide comprises:

a rectangular waveguide, said aperture being substantially centered in a broad wall thereof.

4. A right angle microstrip to waveguide transition, comprising:

a waveguide defining a first direction of propagation;

a dielectric substrate lying in a plane substantially perpendicular to said first direction of propagation;

an aperture in a transverse wall of said waveguide;

a tab of said dielectric substrate extending through said aperture into said waveguide;

a ground plane disposed on a first side of said dielectric substrate;

a conductive probe disposed on said tab, said probe being located within said waveguide and having a first impedance;

a microstrip line disposed on a second side of said dielectric substrate, said microstrip line being located exterior to said waveguide; and a microstrip transition section disposed on said tab connecting said probe and said microstrip line, said transition section being located within said aperture and having an impedance greater than said first impedance, whereby capacitive interaction with said waveguide wall is minimized, said transition section having a length substantially equal to an intergral multiple of one-half of a microstrip wavelength, whereby said first impedance appears unchanged at said microstrip line.

5. The transition according to claim 4 further comprising:

short circuit means for terminating said waveguide, said short circuit means being located a predetermined distance from said conductive probe.

6. The transition according to claim 5 wherein said waveguide comprises:

a rectangular waveguide, said aperture being substantially centered in a broad wall thereof.

7. The transition according to claim 5 wherein said probe faces away from said short circuit means.

8. The transition according to claim 5 wherein said probe faces toward said short circuit means.

* * * * *